US006135406A

United States Patent [19]

DeStefano, Jr.

[11] Patent Number: 6,135,406

[45] **Date of Patent: *Oct. 24, 2000**

[54] LAB-TOP WORK STATION

[76] Inventor: Albert M. DeStefano, Jr., 75 First Ave. & Tillman St., Raritan, N.J. 08869

[ * ] Notice: This patent is subject to a terminal disclaimer.

[21] Appl. No.: 08/393,851

[22] Filed: Feb. 24, 1995

Related U.S. Application Data

[62] Division of application No. 07/940,508, Sep. 4, 1992, Pat. No. 5,290,521.

[51] Int. Cl.[7] ..... A47F 5/00

[52] U.S. Cl. ..... 248/309.1; 403/325; 403/327; 211/183

[58] Field of Search ..... 248/309.1; 403/325, 403/327; 211/183, 184

[56] References Cited

U.S. PATENT DOCUMENTS

| | | | |
|---|---|---|---|
| 3,142,470 | 7/1964 | Tandiovio et al. | 403/325 X |
| 3,168,124 | 2/1965 | Lenkey . | |
| 3,520,660 | 7/1970 | Webb et al. . | |
| 3,550,893 | 12/1970 | Waitzkin | 248/309.1 |
| 3,687,175 | 8/1972 | Babey et al. . | |
| 4,105,347 | 8/1978 | Gossage | 403/327 X |
| 4,276,048 | 6/1981 | Leaback . | |
| 4,478,094 | 10/1984 | Salomaa et al. . | |
| 4,518,002 | 5/1985 | Battiston et al. | 403/325 X |
| 4,640,301 | 2/1987 | Battiston et al. | 403/325 X |
| 4,890,930 | 1/1990 | Nohso . | |
| 4,919,894 | 4/1990 | Daniel . | |
| 4,988,618 | 1/1991 | Li et al. . | |
| 5,055,263 | 10/1991 | Meltzer . | |
| 5,055,271 | 10/1991 | Golias et al. . | |

*Primary Examiner*—Robert W. Gibson, Jr.
*Attorney, Agent, or Firm*—William C. Long

[57] ABSTRACT

The invention relates to a lab-top work station which is designed for use in the manual application of liquid to a slide or microwell plate and consists of a slide holder, a bridge for support of manual liquid dispensers at a predetermined location with respect to the slide holder, and a manual incremental advance mechanism for manually moving the slide holder a predetermined distance.

1 Claim, 9 Drawing Sheets

LAB-TOP WORK STATION

This application is a divisional of U.S. patent application Ser. No. 07/940,508, filed Sep 4, 1992, now U.S. Pat. No. 5,290,521.

BACKGROUND OF THE INVENTION

1. Field of the Invention

The present invention relates to an inexpensive, portable work station for manually applying a liquid solution from a hand-held liquid dispenser, such as a multiple pipette dispenser, with greatly improved accuracy to a multi-well slide or plate.

2. Background of the Invention

In many fields and most notably in the medical field, the application of liquid solution from one or more liquid applicators to a a plate or slide in an accurate and convenient fashion is of great importance.

There exists, for example, fully automated devices for dispensing liquid solution from a plurality of dispensers such as pipettes, in controlled amounts to specific locations on a plate or slide. A problem with such devices has been that they are extremely costly, frequently far beyond the means of smaller laboratories.

U.S. Pat. Nos. 4,478,094 and 5,055,263 relate to automated liquid transfer procedures. The devices described are not adapted for portable, manual operations as is the device of the present invention.

U.S. Pat. No. 4,988,618 relates to magnetic separation devices for use in immunoassay or hybridization assay procedures. The reference does not describe the portable, manually operated device of the present invention.

U.S. Pat. No. 4,919,894 provides an apparatus for pipetting material in individual microwells on a micro-teter plate. The reference does not describe the apparatus of the present invention which is believed to be easier to use and more accurate.

U.S. Pat. No. 4,276,048 provides an automated device fors conducting a multiplicity of chemical reactions with micro-volumes of liquids. The reference does not show the manually operated portable apparatus of the invention.

U.S. Pat. No. 3,168,124 describes a fluid sampling apparatus which acquires a fluid sample and dispenses the sample into a container such as a test tube. The reference does not show the apparatus of the present invention.

There are many applications, especially in the medical testing area, where laboratory workers must apply a liquid solution with a hand-held liquid dispenser to a multi-well slide or plate in a convenient and accurate manner. In such applications it is important that the slide or plate be held in a steady and precise alignment, that the hand-held liquid dispenser be held steady in alignment with the slide or plate and that the liquid be dispersed accurately onto the slide or plate.

The present invention provides a portable device which is specifically designed to assist a lab worker in the use of a hand-held liquid dispenser in the convenient and accurate application of a liquid solution onto a slide or microwell plate.

An important object of the invention is to provide the lab worker with an optimum working environment, means for accurate application and in a time saving fashion, when applying a liquid solution onto a slide or microwell plate.

An object of this invention is to provide a device which is portable and may be used and operated in any appropriate setting with ease and accuracy.

Another object of the invention is to provide an improved method for use of a hand-held dispenser with ease and accuracy, greatly enhancing the working performance of the operator.

Yet another object of this invention is to provide a sterile working surface in that the device of this invention can be run through an autoclave for sterilization after each use.

BRIEF DESCRIPTION OF THE INVENTION

The work station of the present invention comprises a flat base, a slide or microwell plate holder which is positioned between two parallel side rails attached to the base and which is adapted to be moved a predetermined distance by the operation of a manual lever. Positioned over the slide or microwell plate holder is a bridge which is adapted to align and hold steady hand-held liquid dispenser means such as multiple pipettes for convenient and accurate manual application of liquid to specific locations on the slide or plate.

The same numbering of the elements of the work station of this invention is used in all of the attached drawings.

DETAILED DESCRIPTION

Figure 1:
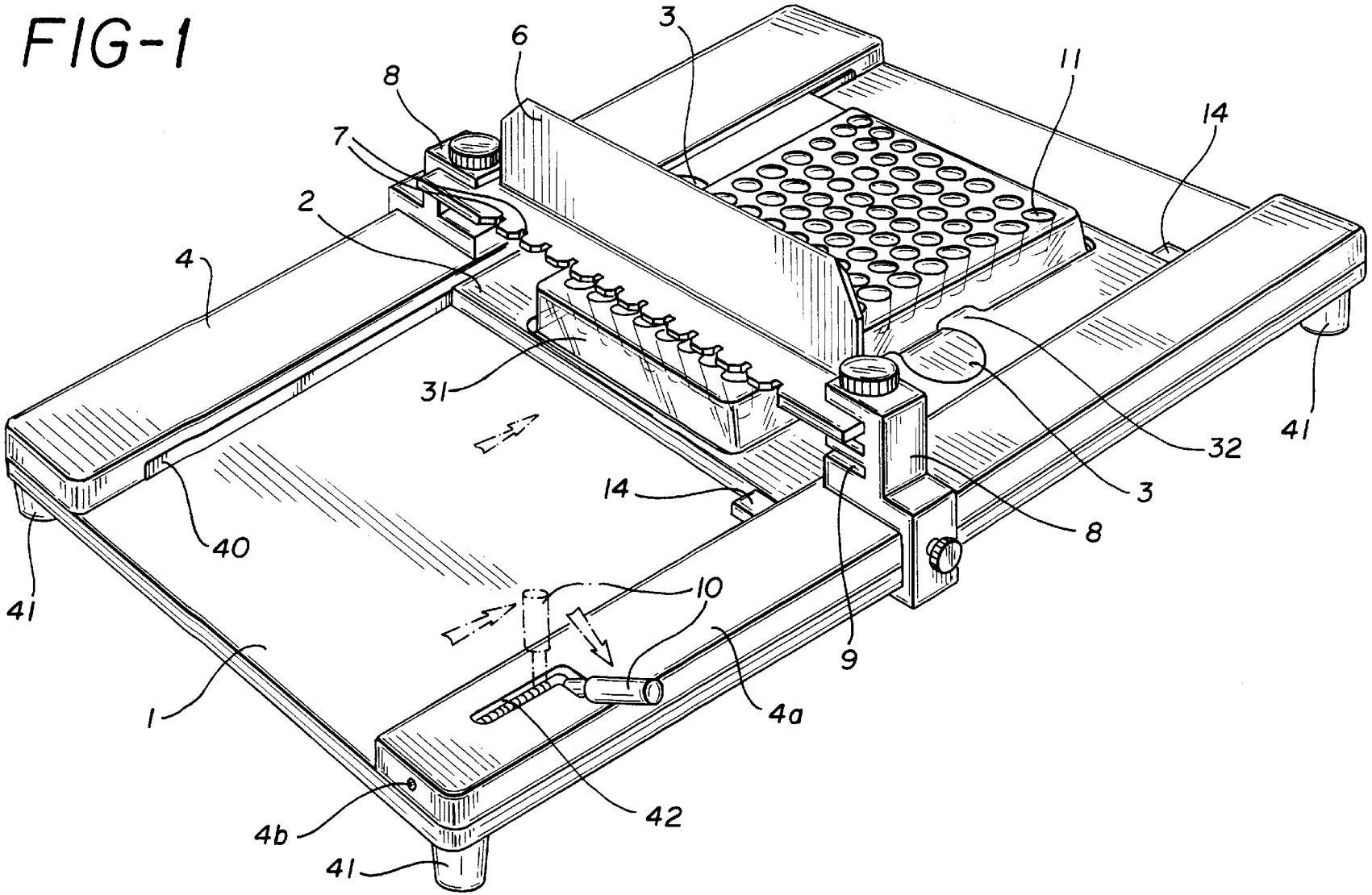
FIGS. 1 and 1*a* illustrate a suitable apparatus in accordance with the invention with the slide or plate holder in different positions.
Figure 1A:
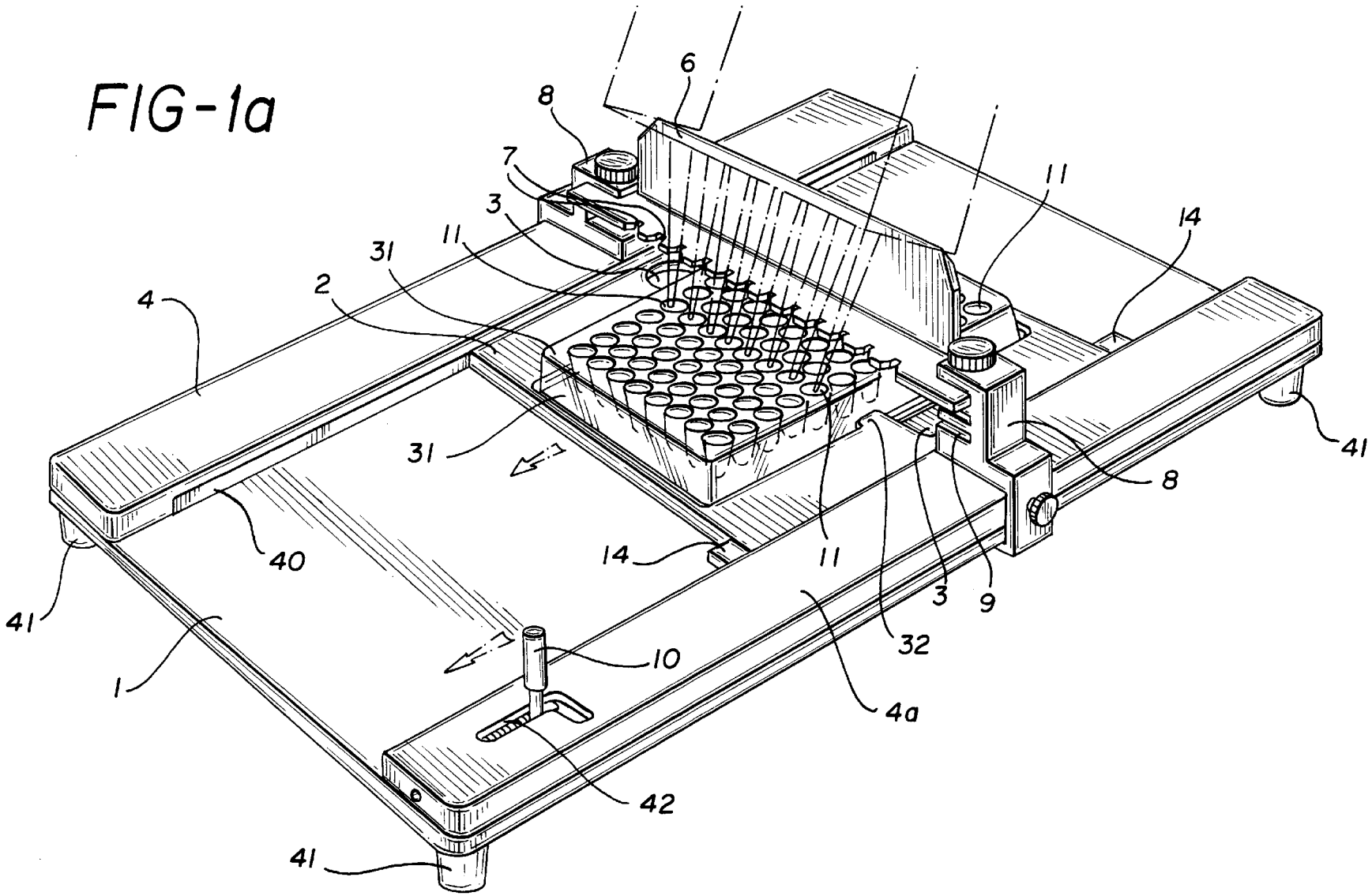
Figure 2:
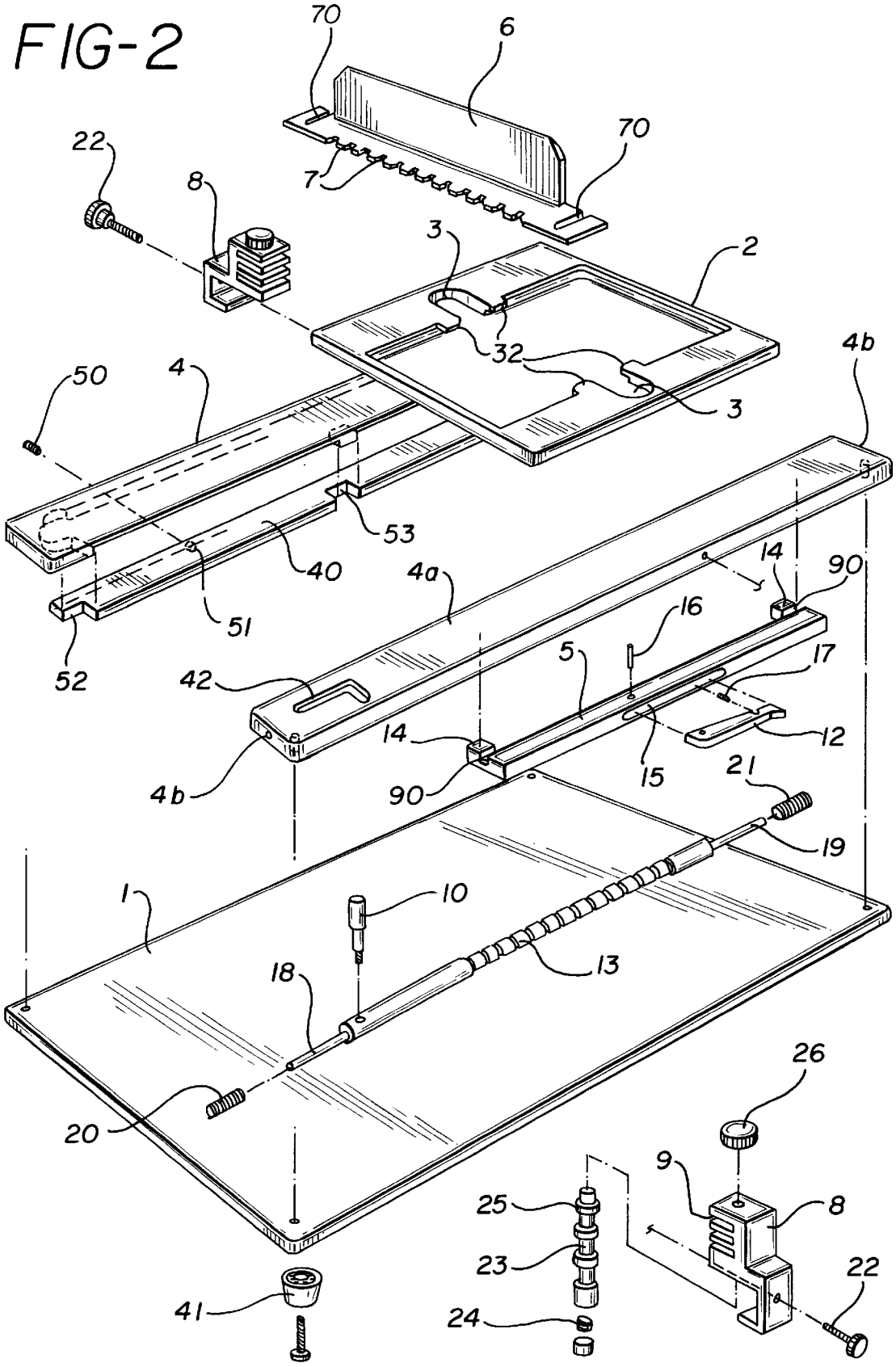
FIG. 2 illustrates an exploded view of portions of the apparatus of FIGS. 1 and 1*a*.

A lab-top work station configuration in accordance with the present invention is illustrated in FIGS. 1, 1*a* and 2 in which the overall work station is shown in FIGS. 1 and 1*a* and an exploded view of various elements of the work station is shown in FIG. 2. Referring to FIGS. 1, 1*a* and 2, a lab-top flat base 1 is provided on which there is positioned a slide or plate holder 2 which is adapted to securely hold an appropriate glass slide or microwell plate in place. In a preferred embodiment, holder 2 is provided with at least two recessed indentations 3 which extend at least to the edge of the slide or plate and preferably extend slightly past the edge and which enable the slides or plates to be easily placed by hand in the holder and manually lifted therefrom.

The slide or plate holder 2 is positioned on base 1 between parallel guide rails 4 and 4*a* and between projections 14 of intermittent ratchet advance means 5.

Mounted over lab-top base 1 is bridge 6 which is adapted to support a plurality of manual liquid dispensing means such as pipettes in stable position for the manual application of solution quickly and accurately to designated locations 11 on a slide or plate. In an especially preferred embodiment as shown, for example, in FIG. 2, bridge 6 is provided with a plurality of grooved slots 7 which are adapted to hold the liquid dispensing means in place as shown in phantom in FIG. 1*a*.

The bridge 6 is held in place by two adjustable bridge support mounting means 8. Appropriately, adjustable bridge support mounting means 8 are provided with slots 9 for receiving the bridge and holding the bridge securely in a fixed position over the lab-top base. In especially preferred practice, each adjustable bridge support mounting means 8 has a plurality of slots 9 at different levels such that bridge 6 can be mounted at different convenient heights above base 1 for ease and accuracy of applying liquid to a slide or plate from manually-held liquid dispensing means. This feature can be seen in the drawings, especially FIGS. 1, 1*a,* 2 and 4.

Side rail 4*a* is recessed on its underside and incorporates in the recessed portion means for advancing slide or plate holder 2 is a predetermined distance by manual operation of lever 10. This sis shown, for example, in FIGS. 3, 3*a* and 3*b*.

In operation as shown, for example, in FIGS. 1 and 1*a,* a slide or plate 31, to which liquid is to be applied, is placed in the rectangular recess in holder 2. The slide or microwell plate 31 is of the type conventionally used and most commonly has 96 separate wells in 8 by 12 rows. Microwell plates, for example those sold by the Cole-Parmer Instrument Company, generally have greater depth than do glass slides, and the rectangular recess of slide or plate holder 2 is sized to securely hold the slide or plate in the desired position. It is usually advantageous to have a plurality of holders 2 sized respectively to securely hold slides and plates; the holders for plates generally have a deeper rectangular recessed portion to receive the plates as well as a slight lip 32 to hold the plates in place as shown in FIGS. 1, 1*a,* 2, 3, 3*a* and 3*b*. In the case of application of liquid to slides, holder 2 need not have lips 32; this is not illustrated.

The design of holder 2 is of special importance in accordance with the invention. As shown, for example, in exploded FIG. 2, holder 2 is square in shape with a rectangular recess having sides parallel to the sides of holder 2 which is sized to receive and hold securely in place a slide or plate. In FIGS. 1 and 1*a* there is depicted a conventional microwell plate 31 positioned in holder 2.

Since holder 2 is square in shape, holder 2 can be inserted between projections 14 of holder 5 such that the slide or plate well rows having the desired number of well locations are parallel to bridge 6. In FIG. 1 and 1*a,* holder 2 is positioned such that microwell plate rows having 8 wells are parallel to bridge 6 for liquid application with a dispenser having 8 pipette tips. Where a 12 pipette dispenser is to be used, holder 2 is rotated 90 degrees before insertion and is inserted in holder 5 such that the slide or microwell plate 31 rows having 12 wells are parallel to bridge 6.

A further feature of holder 2 is that it is designed such that the slide or plate wells are properly aligned to receive liquid from the manual dispenser whether the 8 or alternately 12 well rows are parallel to bridge 6. This can be accomplished by locating the center of the rectangular recess within square holder 2 at the center of holder 2. When square holder 2 is removed and rotated 90 degrees and placed on base 1 between projections 14, liquid can be applied to either an 8-well row or alternately a 12-well row with the appropriate pipettor and pipette tips with the same point of reference when incremented.

In operation, lever 10 is manually depressed in L-shaped slot 42 of side rail 4*a* as shown in FIG. 1 permitting the holder 2 to be moved by hand from a holding position at the left of base 1 to a starting position at the far right of base 1 as shown in FIG. 1. Lever 10 is than moved to an upright position in slot 42 as shown in FIG. 1*a* thus engaging intermittent advance means 5 for moving holder 2 a predetermined distance when upright lever 10 is moved. Subsequently, lever 10 is moved to the left to advance the holder 2 the predetermined distance, usually corresponding to the distance between centers of wells on the slide or plate 31. When the slide or plate 31 has been advanced to position for application of liquid, a hand-held multiple pipettor liquid dispenser is positioned resting against bridge 6 with the dispenser tips aligned with the wells of a particular row on slide or plate 31 as illustrated, and liquid is manually dispensed thereon. A suitable dispenser is partially illustrated in phantom in FIG. 1*a*.

Lever 10 is then manually moved to the left usually by the thumb and forefinger of the operator to advance holder 2 with the slide or plate 31 positioned thereon to bring the next row of wells to the appropriate position for application of liquid thereto. This procedure is repeated until all of the wells on the slide or as many as desired have had liquid applied thereto. In the view illustrated in FIG. 1*a,* the liquid dispenser is shown dispensing liquid to the fifth row of wells.

Lever 10 in the upright position in slot 42 is positioned such that its travel to the left is a distance which is the same as that between centers of wells on the plate or slide 31, usually 9 mm.

When the application of liquid to a particular slide or plate 31 is complete, the slide or plate 31 is removed from the holder 2 and a fresh slide or plate 31 can be inserted for subsequent liquid application procedures. Holder 2 can easily be removed and sterilized between liquid applications.

Conveniently, the base 1 is provided with feet 41, usually made of rubber, for ease of use on a laboratory table surface, and it is advantageous to assemble the apparatus by screws passing through the feet 41 and the base 1 and securing the screws to guide rails 4 and 4*a* as illustrated in FIGS. 1, 1*a* and 2, for example.

FIG. 2 is an exploded view of various components of the apparatus of the invention shown in FIGS. 1 and 1*a,* and illustrates in more detail certain of these components. Specifically, as previously indicated, retaining rail 4*a* is recessed in its underside, and positioned in the recess is intermittent ratchet advance 5. As depicted in FIGS. 2, 3, 3*a* and 3*b,* for example, intermittent ratchet advance 5 is a U-shaped component lengthwise, and only the end projections 14 extend outwardly from under rail 4*a*. The distance between projections 14 is sized to closely fit the dimensions of holder 2 in order that square holder 2 may be maintained securely between these projections on base 1.

Figure 3:
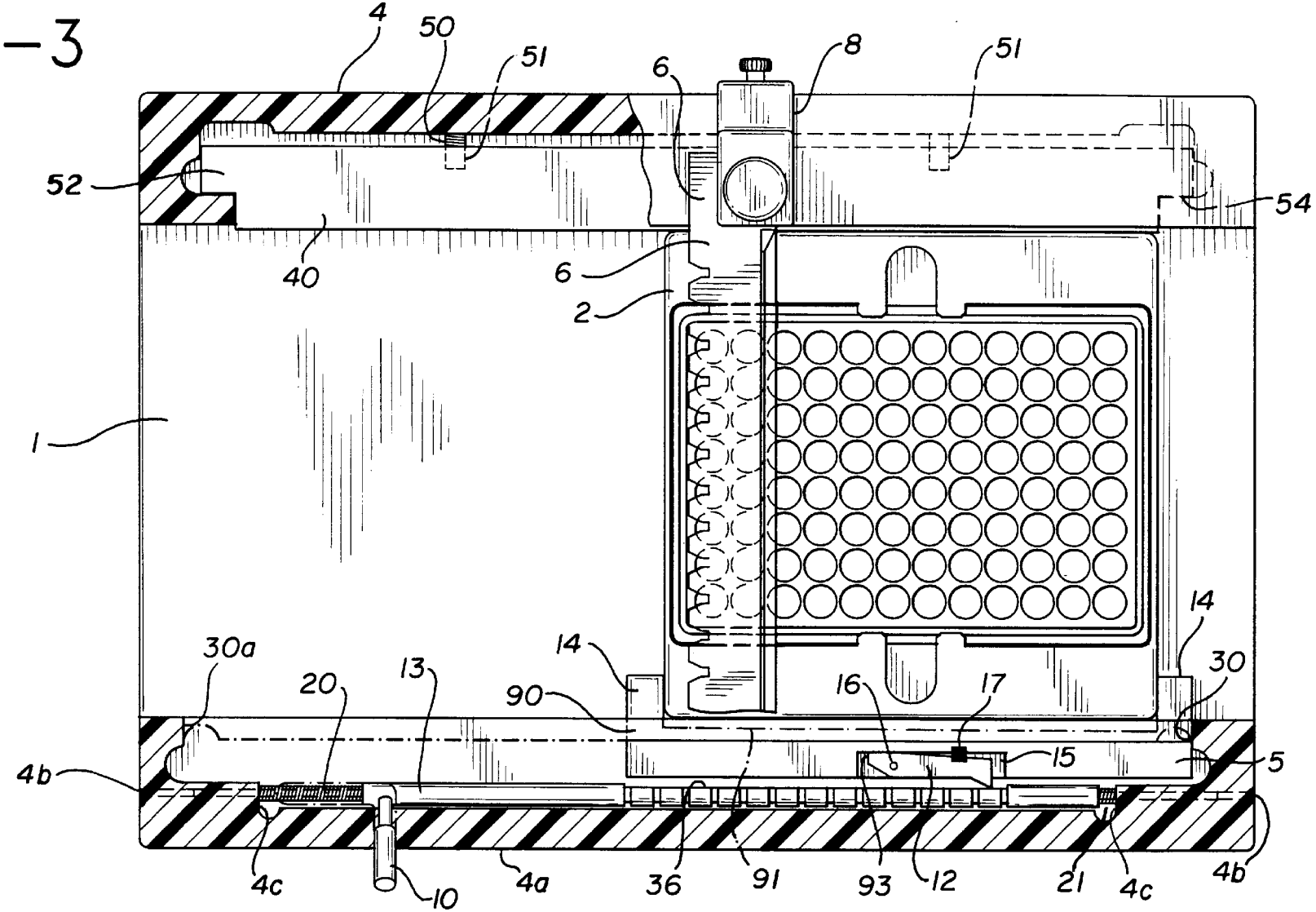
FIGS. 3, 3*a* and 3*b* illustrate a preferred ratchet and lever configuration for manually advancing the slide holder as well as an optional friction bar.
Figure 3A:
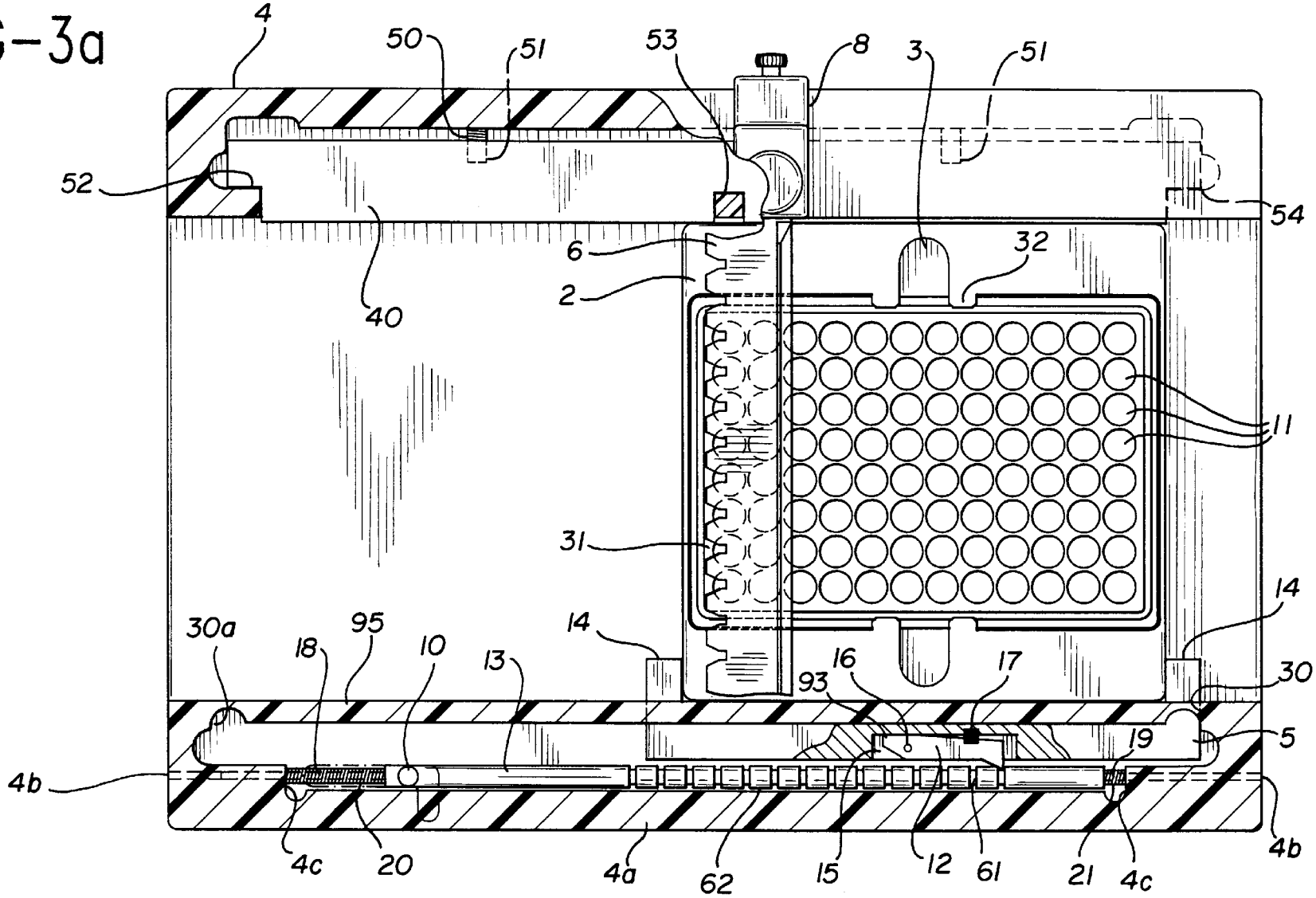
Figure 3B:
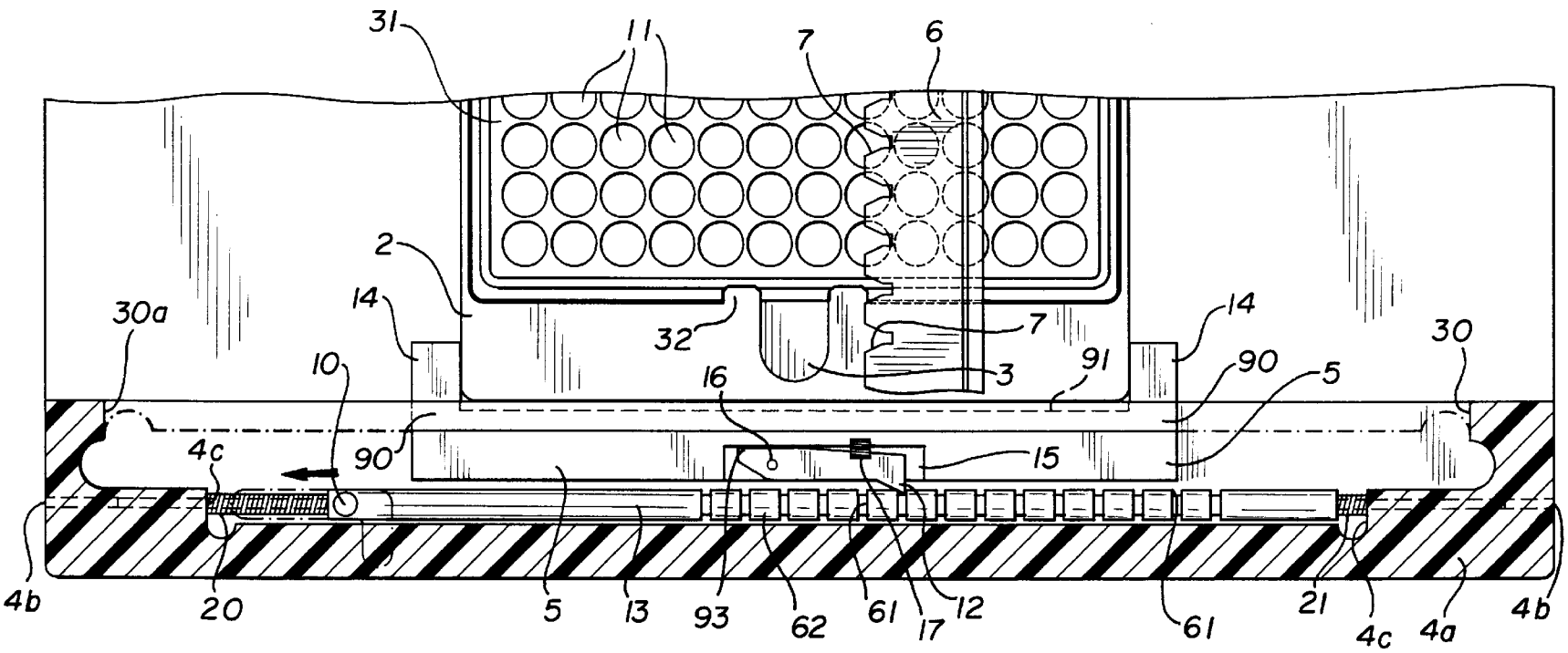

Ratchet clip 12 is inserted in a slot 15 in intermittent ratchet advance means 5 and secured therein with pin 16; ratchet clip 12 is mounted in slot 15 such that only the pawl projects past the slot as will be seen in FIGS. 3, 3*a* and 3*b*. Spring 17, which is inserted in slight counterbores in intermittent ratchet advance 5 and ratchet clip 12, exerts an outward pressure on the pawl of ratchet clip 12. Ratchet clip 12 is shaped such that the pawl end thereof projects from slot 15 and contacts rod 13 while the head end at 93 contacts the bottom of slot 15 and thus controls the distance of travel of the pawl of clip 12.

Notched incremental control rod 13 is provided with smaller diameter pins 18 and 19 at the ends thereof which smaller diameter pins fit in guide holes 4*b* at either end in underside rail 4*a*. Springs 20 and 21 fit over pins 18 and 19 and abut edges 4*c* provide opposing pressure against incremental control rod 13 in guide holes 4*b* to maintain position. Incremental control rod 13 is positioned between holder 5 and the two walls of rail 4*a* and base 1 in the recessed underside of rail 4*a*.

L-shaped slot 42 is provided in guide rail 4*a* to guide the movement of lever 10. Lever 10 is mounted through slot 42 and secured to incremental control rod 13 such as by being screwed into incremental control rod 13. Slot 42 guides lever 10 as it is moved manually from the depressed position shown in FIG. 1 to the upright position as shown in FIG. 1*a,* and as lever 10 is moved to the left to advance holder 2.

In especially preferred practice, rail 4 also has a recessed underside in which is positioned friction bar 40 which exerts a slight pressure on holder 2 against rail 4*a*. With particular reference to FIGS. 3 and 3*a,* a plurality of springs 50 are mounted in apertures 51 in friction bar 40 and provide the necessary pressure; although only one such spring is illustrated, generally at least 2 springs placed at equal distances from the ends of friction bar 40 are used to provide uniform pressure. The friction bar 40 is restrained at notched points 52, 53 and 54 as shown, for example, in FIG. 3*a,* of rail 4 from extending an excessive distance past rail 4. Friction bar 40 extends only a very slight distance past rail 4 in order to provide a small uniform pressure on holder 2 against rail 4*a*.

Figure 4:
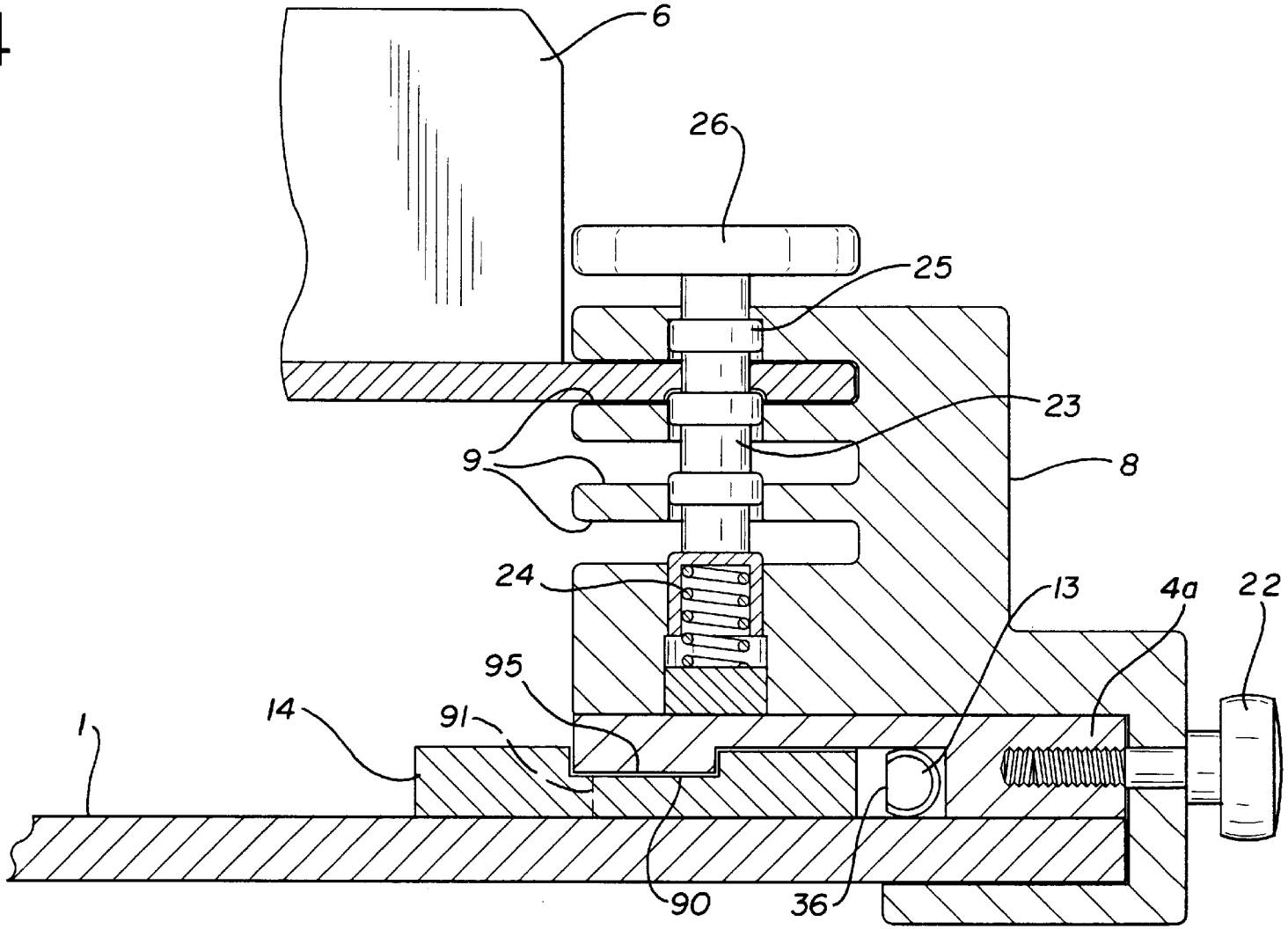
FIG. 4 illustrates the preferred bridge support.

With reference to FIGS. 2 and 4, holder 5 is U-shaped lengthwise and is provided with slots 90 which engage the lower rail 95 on underside of rail 4*a* on the side adjacent holder 2. It is important that slots 90 maintain holder 5, except for end projections 14, slightly recessed within rail 4*a* such that holder 2 contacts only projections 14 of holder 5 as well as rail 4*a*. Upon application of the slit pressure from friction bar 40, holder 2 contacts side rail 4*a* but not edge 91 of holder 5 which is recessed within rail 4*a*. See FIGS. 3 and 3*b*. The slight pressure of holder 2 on rail 4*a* provides the slight resistance to holder 5 via projections 14 to aid in accuracy of movement of holder 2 in operation of the incremental advance means.

Referring next to FIGS. 3, 3*a* and 3*b,* these Figures provide additional information with regard to operation of the lab-top work station of the present invention using the same numbering as in FIGS. 1, 1*a* and 2. Referring to FIG. 3, 3*a* and 3*b,* means 5 is shown sized to securely maintain holder 2 in place and advance same through action of lever 10 and incremental control rod 13. Incorporated in means 5 is ratchet clip 12 with spring 17 as previously described.

Incremental control rod 13 is mounted in the recessed hollow space at the underside of rail 4*a* between points 4*c* by insertion of pins 18 and 19 through springs 20 and 21 into guide holes 4*b*. Preferably, control rod 13 is made of a flexible one-piece plastic and is flexed for ease of insertion in guide holes 4*b*. Control rod 13 is sized longer than the distance between points 4*c* to permit the necessary advancing motion due to action of lever 10 while always remaining in guide holes 4*b*.

Notched incremental control rod 13 has a flat side 36 and is positioned such that when lever 10, which is screwed into rod 13, is depressed as indicated in FIG. 3, notched incremental control rod 13 is rotated to the position shown wherein the flat side 36 of incremental control rod 13 contacts the pawl of ratchet clip 12 permitting incremental ratchet advance holder 5, and consequently slide or plate holder 2, to be moved as indicated to the far right position where the end of holder 5 abut edge 30 of the recessed portion of rail 4*a* placing the plate or slide in appropriate starting position. A comparable edge 30*a* acts as a stop at the left side for holder 5.

As shown, for example, in FIGS. 3*a* and 3*b,* incremental control rod 13 has a plurality of segments 62 which are separated by recesses 61. Generally the length of segments 62 corresponds to the distance between well centers on the slide or plate 31 which is the distance it is desired to move holders 2 and 5 on each incremental advance.

When level 10 is manually moved to the upright position in slot 42 as indicated in FIG. 3*a* and 3*b,* notched incremental control rod 13 is rotated to the position shown wherein the pawl of ratchet clip 12 engages recessed space 61 between segments 62 as shown.

FIG. 3*a* shows the starting position with the pawl of ratchet clip 12 engaged in the first recessed space 61 of control rod 13.

FIG. 3*b* shows position of the various components at an intermediate stage of the liquid application.

When lever 10 is moved to the left, notched incremental control rod 13, which is engaged to intermittent ratchet advance holder 5 by ratchet clip 12, moves the same distance and transfers holder 5 and plate or slide holder 2 this predetermined distance. By this mechanism, the holder 2, and consequently a slide or plate positioned therein, is moved the designated distance to the left bringing a fresh row of slide or plate wells 11 into position for application of liquid thereto. When lever 10 in the upright position is released by the operator, it returns to the position shown in FIG. 3*b* until it is against manually moved by the operator after application of liquid to the appropriate wells 11 on the slide or plate 31, and this procedure is repeated until liquid has been applied to as many wells as desired.

When liquid application to a particular slide or plate 31 has been completed, the slide or plate 31 is lifted from holder 2, a fresh slide or plate 31 can be inserted, and by depression of lever 10, notched incremental control rod 13 is rotated so that the flat side 36 again engages the pawl of ratchet clip 12 and the plate or slide holding device 5 can be moved and reset at the far right starting position as shown in FIG. 3.

Figure 5:
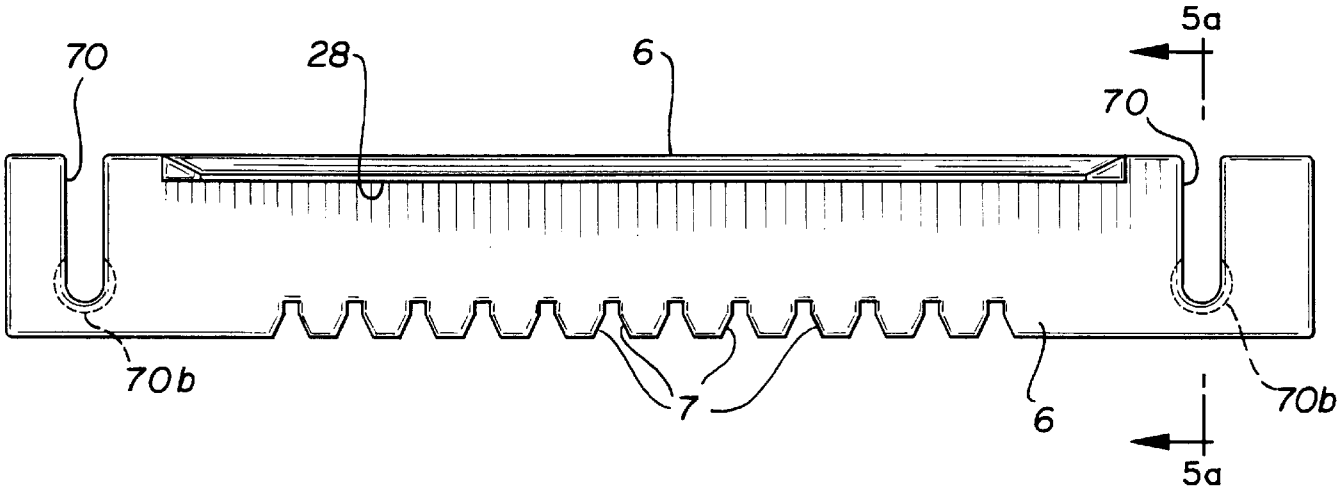
FIGS. 5 and 5*a* illustrate a suitable bridge configuration.

FIG. 4 illustrates a suitable and preferred means for holding bridge 6 in proper position over the work station base 1. Referring to FIG. 4, bridge support means 8 can be either of the bridge retaining means shown in FIGS. 1 and 1*a* since these are interchangeable. Bridge support means 8 are secured to guide rails 4 and 4*a* (shown as rail 4*a*) by means of screw connection 22. The side rails 4 and 4*a* can have a plurality of holes such that bridge support means 8 can be secured at a number of locations. It should be noted that the position of bridge support means 8 on the guide rails is such that when a fresh slide or plate 31 positioned in holder 2 is at the starting position shown in FIG. 3, the location of slide or plate 31 with respect to bridge 6 is such that the first row of wells 11 on slide or plate 31 can easily be brought forward into the proper position for dispensing liquid. As sown in FIG. 4, snap lock pin 23 is inserted in support 8 and is provided with spring 24 which exerts pressure on snap lock pin 23 in the upward direction. Projections 25 are located on the shaft of snap lock pin 23 as indicated and head 26 is provided for ease of manual operation. With reference to FIGS. 2, 4 and 5, bridge 6 is provided with slots 70 which engage shaft 23 of bridge support 8. When bridge 6 is positioned so that slot 70 is fully inserted on the shaft of snap lock pin 23, the bridge is located in the proper position. Counterbores 70*b* is provided at the end underside of slot 70 as illustrated so that when snap lock pin 23 is released, spring 24 forces snap lock pin 23 to the upward position causing projections 25 to lock into counterbore 70*b* at the underside of slot 70 of bridge 6 thereby locking the bridge tightly into the desired position. When it is desired to release the bridge for purposes of removal, snap lock pin 23 is depressed by manually depressing head 26 on both sides causing projections 25 to move downwardly and releasing these projections from the counterbores 70*b* at the underside of slot 70, thus enabling bridge 6 to be removed.

Obviously, other support means can be employed in practice of the present invention, but the above support configuration has been found to be especially useful. In FIG. 4, bridge support means 8 is shown with 3 slots 9 at different levels, but it will be apparent to those skilled in the art that any convenient and desired number of slots can be employed.

In especially preferred practice, the lower slots 9 are employed to hold the bridge in the case of liquid application to wells on a slide with the higher slots used for liquid application to wells on microwell plates.

With regard to the bridge structure which is employed in order to align and position the liquid dispensing means, an especially preferred bridge configuration is set forth in attached FIG. 5. Referring to FIG. 5, bridge 6 is shown with slots 70 for engaging the support means. As shown in FIG. 5, slots 70 and counterbore 70*b* are entered from the back of the bridge, but equally feasible is the provision of slots 70 with entry from the bridge front or with entry from both front and back.

Bridge 6 is provided with grooved slots 7 which support and stabilize the liquid dispensing means such as the pipette ends of a multiple pipette dispenser as shown in phantom in FIG. 1*a*. Grooved slots 7 are positioned to correspond precisely to the spacing between wells on the slide or plate 31 to which the liquid is to be dispensed as shown, for example, in FIG. 1*a*. Most generally, the distance between such locations is 9.0 mm although this, of course, can vary.

A particularly preferred configuration for grooved slots 7 is described in FIG. 5 wherein the slots are provided with a front area with converging sides for location of the pipette and a rear, smaller area shown as a rectangular notched portion.

Figure 5A:
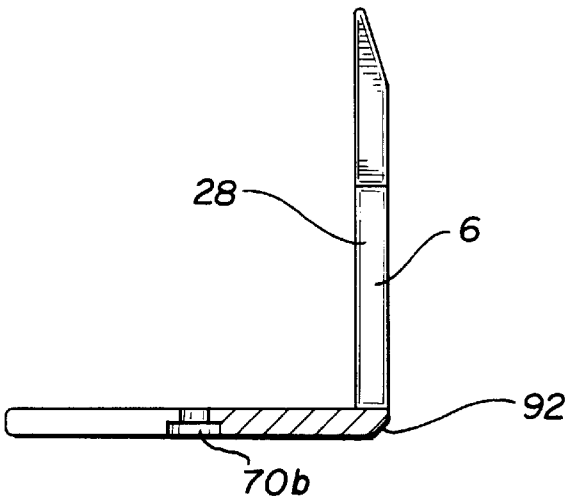

As shown in elevation view 5*a*, bridge 6 has upright portion 28 having a height consistent with the dispensing equipment to be used, the receiving plate or slide, and the ease and comfort of the person making the liquid distribution. Both the width of the lower slotted portion of bridge 6 and the height of upright portion 28 can be varied in size to ensure that the dispenser angle is comfortable for liquid application for the pipette size to be used. The upper portion of element 28 tapers to a point upon which the liquid dispenser, most notably a multipipette dispenser, rests. It is especially useful for ease of inserting and locking the bridge 6 in bridge support 8 that the edge to be inserted be angled at, for example, 30 degrees, as shown at 92 in FIG. 5*a*.

It is generally advantageous to provide a plurality of bridges with a given apparatus to be used according to the invention. The bridges can have different heights, different slots depths and different base widths, all designed to provide maximum ease of liquid application for a particular system which is to be employed by the user. An important feature of the invention is that the various components of the apparatus such as the bridge, the slide or plate holder, and the like, are readily removed and can be separately sterilized to ensure optimum sanitary conditions.

Figure 6:
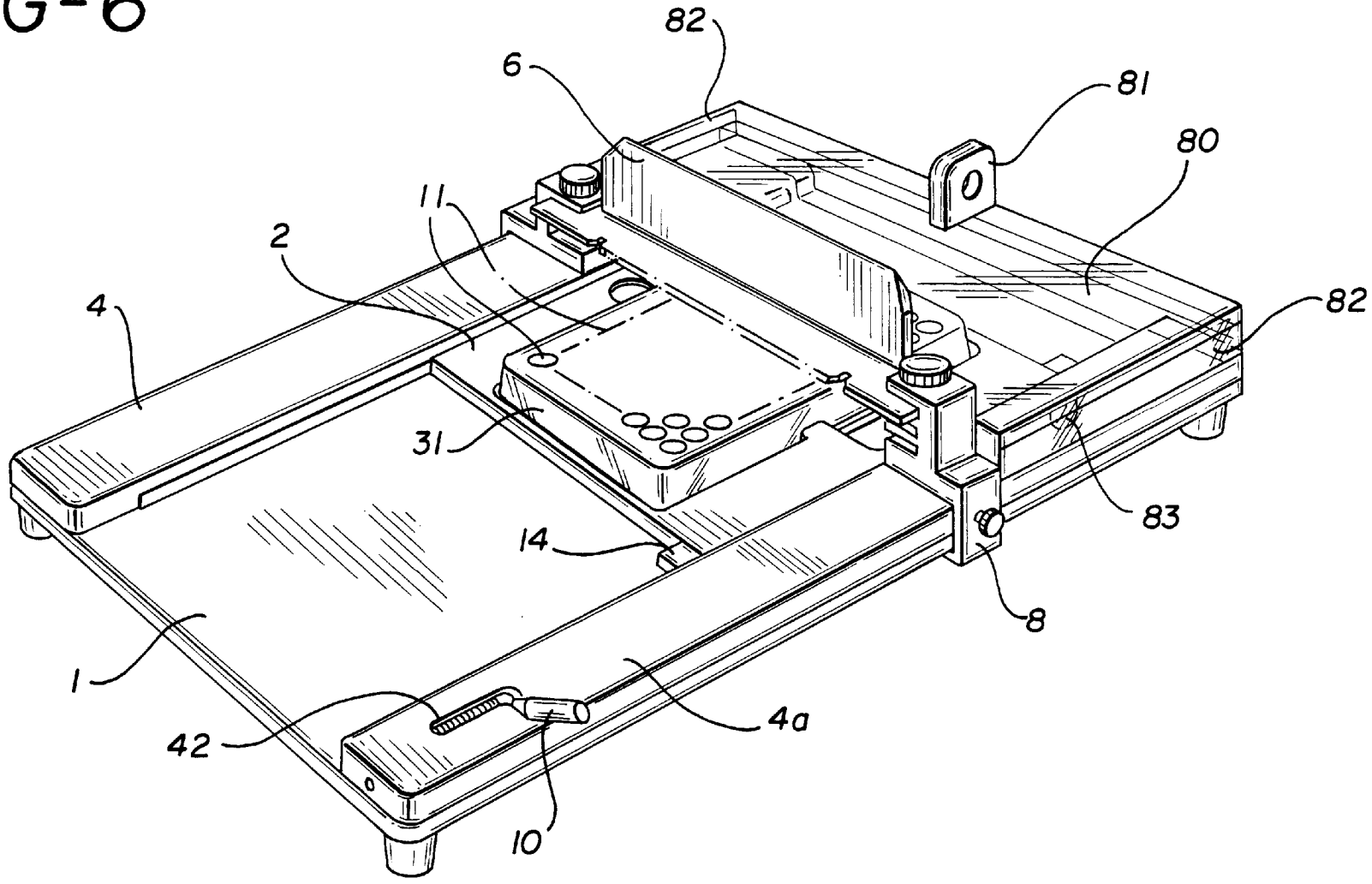
FIG. 6 illustrates the use of a partial cover with the apparatus of the invention.

A particularly preferred practice of the invention involves the provision of a separate cover which is placed over the lab-top work station to the right of the bridge supports 8 as illustrated in FIG. 6. Appropriately, this cover 80 is made of a clear plastic material so that the components cover are clearly visible to the operator. Cover 80 is provided with handle 81 for convenience in manual removal of the cover. The function of cover 80 is to protect the unused wells on slide or plate 31 prior to the application of liquid thereto. The use of cover 80 prevents inadvertent contamination of the well sites 11 prior to dispensing liquid onto the appropriate sites.

Cover 80 is of a generally rectangular configuration with an open side adjacent bridge 6 and with side members 82 adapted to fit over rails 4 and 4*a* respectively. Preferably, side members 82 are solid members with a flat bottom adapted to rest on rails 4 and 4*a*. A rear panel is provided to enclose the area behind the bridge when the cover is in position. Preferably, the cover is made of a clear plexi-glass material in order to enable the operator to see through the cover during operation. In the embodiment of the invention employing cover 80 in conjunction with the lab-top work station, it is advantageous to provide knob or pin means 83 secured to the top of side rails 4 and 4*a* and projecting upwardly therefrom to engage a recess in members 82, thus to hold cover 80 securely in place during use. Any number of appropriate means can be employed in order to ensure that cover 80 remains in position during use, but most conveniently, such means are in the form of knobs or projections 83 which are glued or screwed onto the side rails 4 and 4*a* and which are adapted to engage members 82.

Generally speaking, base 1 is made of a hard plastic, although metal can be employed where desired. Likewise, most of the other components preferably are made of plastic, although frequently bridge 6, support means 8, holder 2 and/or holder 5 are conveniently made of metal such as aluminum or stainless steel as is ratchet clip 12. However, the material of construction for the various components can be varied depending on the cost and preferably the availability of various non-corrosive and autoclavable materials and the ease of forming and assembling the various components as well as the specific use extended for the work station.

The apparatus set forth herein is broadly applicable, especially in the field of biological testing.

Included among the outstanding advantages which are achieved by the present invention is the fact that use of the lab-top work station of this invention substantially improves the ease and accuracy of liquid application, improves the ease and accuracy of indexing, and significantly reduces cross-contamination between rows of microwells on a particular slide or plate. Use of the work station of this invention allows the operator to easily keep track of the position on a plate or slide to which liquid is to be applied and aids the operator in determining with ease and precision the slide or plate rows to which liquid has been applied and the rows remaining for liquid application.

It should be noted that the work station depicted in the drawings is designed for a right-handed operator wherein liquid is dispensed with the right hand and lever 10 operated with the left hand. The work station can be made for operation by a left-handed person by reversing the bridge and incremental advance means.

I claim:

1. Bridge support means comprised of a support with horizontal slots adapted to receive and support bridge means having counterbored slots, a spring-loaded snap lock pin vertically positioned in the said horizontal slots of the support means, said snap lock pin comprised of a vertical pin shaft having projections adapted to lock into the counterbore of bridge means slots.

* * * * *